US005778717A

United States Patent [19]

Berger et al.

[11] Patent Number: 5,778,717

[45] Date of Patent: Jul. 14, 1998

[54] PROCESS AND DEVICE FOR ROLLING BANDS WITH UNEVEN THICKNESS AND/OR LENGTH DISTRIBUTION OVER THEIR WIDTH

[75] Inventors: Bernd Berger, Kaarst; H. Dieter Volkenand, Hemer, both of Germany

[73] Assignee: Sundwiger Eisenhutte Maschinenfabrik GmbH & Co., Hemer, Germany

[21] Appl. No.: 673,796

[22] Filed: Jun. 27, 1996

[30] Foreign Application Priority Data

Jul. 7, 1995 [DE] Germany ..... 195 24 729.9

[51] Int. Cl.[6] ..... B21B 39/08

[52] U.S. Cl. ..... 72/205; 72/8.7; 72/12.3

[58] Field of Search ..... 72/8.6, 8.7, 11.4, 72/12.3, 205, 365.2

[56] References Cited

U.S. PATENT DOCUMENTS

| | | | |
|---|---|---|---|
| 4,033,165 | 7/1977 | Arimura et al. | 72/205 |
| 4,033,492 | 7/1977 | Imai | 72/205 |
| 4,187,707 | 2/1980 | Quehen | 72/205 |
| 5,142,891 | 9/1992 | Kuwano | 72/205 |
| 5,329,798 | 7/1994 | Takakura et al. | 72/205 |

FOREIGN PATENT DOCUMENTS

| | | | |
|---|---|---|---|
| 5939413 | 3/1984 | Japan | 72/205 |
| 0399712 | 4/1991 | Japan | 72/13.1 |
| 3238102 | 10/1991 | Japan | 72/205 |
| 4228215 | 8/1992 | Japan | 72/205 |
| 0631325 | 2/1994 | Japan | 72/205 |

*Primary Examiner*—Lowell A. Larson
*Assistant Examiner*—Ed Tolan
*Attorney, Agent, or Firm*—Meltzer, Lippe, Goldstein, Wolf, & Schlissel, P.C.

[57] ABSTRACT

The present invention relates to a process and to a device for the rolling of bands (B) with uneven thickness and/or length distribution over their width by using at least one control roller (5, 9, 21, 27, 41, 43) located on the inlet and/or outlet side of a mill (W, W', W") and capable of swiveling in its position relative to the band (B), making it possible in case of minor disturbances, independently of the existing operating conditions, to compensate for the running of a band caused by unevenness in the thickness and/or length distribution over the width of the band. This is achieved according to the invention in that the distribution of the tensile stress over the width of the band (B) is detected with at least one measuring device (7, 11, 25) and in that the control roller (5, 9, 21, 27, 41, 43) is adjusted in function of the detected distribution of tensile stress until the detected distribution of tensile stress is equal to a desired value.

10 Claims, 3 Drawing Sheets

PROCESS AND DEVICE FOR ROLLING BANDS WITH UNEVEN THICKNESS AND/OR LENGTH DISTRIBUTION OVER THEIR WIDTH

FIELD OF THE INVENTION

The present invention relates to a process and a device for the rolling of bands having an uneven thickness and/or length distribution over their width by using at least one control roller located on the inlet and/or outlet side of the mill and capable of swivelling in its position relative to the band.

BACKGROUND OF THE INVENTION

Bands are generally asymmetrical with respect to uniformity of their thickness and length across their width following the first steps of their manufacture. This applies in particular to metal bands rolled out on hot-strip mills which have generally an uneven convex thickness distribution over their width. Once such bands are divided into lengths, such bands have border strips with a trapezoid thickness profile. This thickness profile cause the strips to run sideways in the nip when such border strips are rolled.

A device intended to prevent the sideways running of a band in the nip is described in the German patent DE 34 05 146 C1. In the known device swiveling band guiding rollers are used in the plane of the band and these apply a lateral guiding force on the bands to act against their excursion. At the same time the arc of wrap of the respective guide rollers can be changed via tipping rollers adjoining the guide rollers, so that the magnitude of the lateral guiding force applied to the band can be changed.

In the known device the centered position of the band is pre-adjusted before starting up the mill. During the operation, the different positions of the band edge are then detected by measuring scanners. A change in the position of the band edge relative to the indicated value of the desired position is interpreted by a regulating device as an indication that the band is off center. The regulating device thereupon transmits a corresponding adjusting signal to an adjusting device which changes the swiveled position of the guide roller in such manner that a centered running of the band is reestablished.

The above-described known device basically achieves its purpose. In practical tests of such a device it has been shown however that the lateral guiding forces which can be applied to the band via the swiveling guide rollers are very much dependent on the friction between band and roller. Non-constant friction conditions, such as they normally occur in practical operation, change the balance of the lateral forces and lead to a lateral shifting of the band on the guide roller. This lateral shift of the band which is known as a "stick-slip effect" causes instability in the angle adjustment of the guide rollers and unstable rolling conditions.

Another disadvantage of the influence of friction between guide rollers and band in the known device consists in the fact that the lateral guiding force of the guide roller swiveling in the running plane of the band depends on the front tension and on the angle of wrap. Practical tests of the known device have shown that an angle of wrap ensuring sufficiently strong lateral guiding forces applied to the band by means of the guide roller cannot be set for all machine geometries and operating conditions.

Finally another disadvantage of the known device is that in this device the eccentricity of the band is used as a regulating magnitude for the regulation of the guide rollers. This has as a result that a certain band course must apply before a regulating action can be taken. It has also been shown in practical testing that the regulating intervention often only occurs at a point in time when the stability limit of the rolling process has already been exceeded. An additional disadvantage of such a regulation consists also in the fact that when the band is inserted off center, a faulty desired value is often given the regulator. This error in entering the desired value finally results in the regulating circuit no longer being able to regulate the swiveled position of the guide roller in the desired manner which is required for a good operating result.

It is the object of the present invention to create a device and a corresponding process for the rolling of bands using simple means, based on the above-mentioned known device and in accordance with the process for band rolling making it possible, independently from any operating conditions applicable, to compensate for the course of the band that is caused by unevenness in the thickness or length evolution over the width of a band in case of a minor disturbance.

SUMMARY OF THE INVENTION

This object is attained for a process of the type mentioned initially, in that the distribution of tensile stress over the width of the band is detected by at least one measuring device located on the same side of the mill as the control roller and in that the control roller is adjusted in function of the detected tensile stress distribution until the detected tensile stress distribution is equal to a desired value.

The process according to the invention takes the fact into account that the lateral course of the band in the nip is caused by an asymmetric distribution of the tensile stress over the width of the band. This asymmetric distribution of the tensile stress over the width of the band has two causes. One of these causes is that in case that the bands are rolled up with a trapezoid thickness profile, an uneven winding condition occurs over their width. The thicker band edge is wound up very tightly here while the thinner band edge is wound up very loosely. If a traction force is now applied to the band at the coiling winches, great tensile stress occurs at the tightly wound border strips of great thickness while a low tensile stress occurs in the areas which are loosely wound. These asymmetric tensions take effect very far into the band.

The second cause for asymmetric tensile stress distribution in cold rolling border strips consists in the fact that in hot strip mills the rolled hot bands normally have also an uneven length distribution over their width in addition to a convex, uneven thickness profile over their width. Thus the bands have a short band center in most cases, and long band sides. This uneven length distribution of the hot strips which is however still symmetric relative to the band center, results in asymmetric length distribution at the edge strips when the bands are divided up. These bands have a short and a long band edge after being divided up. When rolling such divided hot strips with asymmetric length distribution, asymmetric tensile stress occur in the band, whereby the short band edge is subjected to a greater tensile stress and the long band edge to a lesser tensile stress.

According to the process of the invention, the irregularity of the tensile stress distribution over the width of the band is detected on the same side of the mill on which the control roller is also located. In this manner the changes in tension distribution of the band caused by an adjustment of the control roller is detected by the appropriate measuring devices without being influenced on further elements acting upon the band. Thus it is easily possible to apply traction forces to the band in such manner through adjustment of the control roller, that the band can be rolled without any danger of a lateral escaping.

Since no lateral forces need be applied to the band in the process according to the invention, such as is the case with the above-described known device, the influence of changes in friction between the band and the applicable control roller is reduced to a minimum. The process according to the invention also reduces to a minimum the danger of entering a wrong desired regulating value, since it is not a geometrical magnitude of the processed band which is taken as a reference magnitude, but a characteristic value which can be found for all bands or for certain types of bands.

The distribution of tensile stress in the band can be determined advantageously from the difference between the band traction forces detected on the drive and on the operating side of the mill.

The device of the type mentioned initially according to the invention has means for the detection of tensile stress distribution over the width of the band and a regulating device which determines adjusting signals for adjusting devices to swivel the control roller on basis of the detected tensile stress distribution. An embodiment of the invention which is advantageous for minimizing the influence of friction on the results of operation is characterized in that the control roller can be swiveled in a vertical plane. A control roller which is arranged in this manner and can be swiveled does not produce lateral forces but effectively changes the band length and thereby acts directly on the distribution of tensile stress.

Depending on the application it may be advantageous to provide at least one control roller on the inlet side as well as on the outlet side of the mill.

The effect of the different control rollers can be further increased by assigning at least one deflection roller to each control roller. This deflection roller may be installed before as well as after the appertaining control roller, in the direction of band movement. In addition it may be advantageous to provide suitable deflection rollers before and after the different control rollers. The effect of these deflection rollers consists in the fact that when they dip into the band, the angle of wrap at the control rollers is enlarged. With the enlargement of the angle of wrap the influence of the control rollers on the development of tensile stress in the band is increased.

As a rule it will be advantageous to place the measuring devices required to determine the evolution of tension directly in the vicinity of the control roller itself or, in the direction of band movement towards the control rollers, at a certain distance thereafter. The share of tensile stress on the drive and on the operating side may be measured by means of force sensors for example, to determine the evolution of tensile stress, said force sensors being positioned at the bearing blocks of the control rollers or at the bearing blocks of the closely adjoining deflection rollers associated with the control rollers. Furthermore it is well possible, in case that the control rollers or the adjoining deflection rollers are made in form of flatness measuring rollers, to derive the asymmetry of the tensile stress distribution directly from the measuring roller signals.

The versatility of the device according to the invention can be further increased by making it possible to change the distance between deflection and control rollers and the band. In this case the control roller and the deflection roller should be sufficiently far away from the band so that the control roller as well as the deflection roller can be disengaged from the band when necessary. Thus it will be advantageous in many instances to disengage a deflection roller located on the outlet side of the mill from the band when a flatness regulation is used there and as few rollers as possible should come into contact with the band.

It may also be advantageous if two control rollers are located on the inlet and/or outlet side of the mill, one of these control rollers acting upon the upper band surface and the other on the lower band surface. In this manner the versatility of the device according to the invention is further increased. Thus it is easily possible with such a design of the device according to the invention to use only the upper or only the lower control roller, depending on the application. In the identical manner, the two control rollers can be used simultaneously, and in this case the control rollers are swiveled in opposite direction of each other. The interaction of the control rollers achieved in this manner will considerably increase their influence on the tensile stress distribution.

The invention is explained in greater detail below through drawings.

DETAILED DESCRIPTION OF THE PREFERRED EMBODIMENTS

Figure 1:
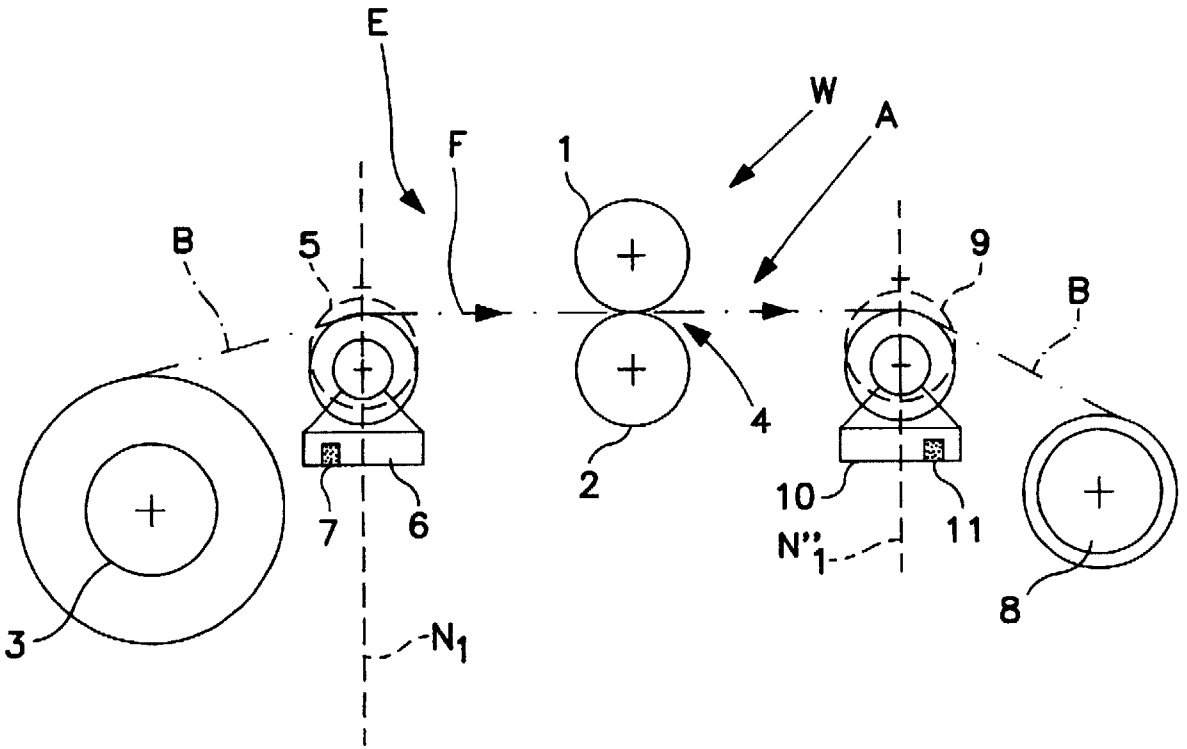
FIG. 1 shows the structure of a device for the rolling of bands in a schematic lateral view.

The device shown in FIG. 1 for the rolling of bands has a mill W with two operating rollers 1, 2. On the inlet side E of the mill W an uncoiling winch 3 is installed by which a band B is conveyed in conveying direction F into the nip 4 between the operating rollers 1, 2 of the mill W. Before entering the operating nip 4, the band B is taken over a first control roller 5. The control roller 5 is mounted on a bearing block 6 to which force measuring sensors 7 are attached to determine the tensile forces acting upon the band B on the inlet side. The control roller 5 can be swiveled via its bearing block 6 by means of adjusting drives (not shown)into a substantially vertical plane $N_1'$.

On the outlet side A of the mill W a coiling winch 8 is installed on which the finished, rolled band B is wound up. Before this the band B is taken via a second control roller 9 located between the nip 4 and the coiling winch 8. The control roller 9 is mounted on a bearing block 10 equipped with force sensors 11 to determine the tensile forces acting upon band B on the outlet side. As with the first control roller 5, the second control roller 9 can be swiveled by means of the adjusting devices (not shown) in a plane $N_1''$ which is substantially vertical.

The force measuring sensors 7, 11 are connected with a regulating device (not shown) which determines the distribution of tensile stress over the width of the band B from the measuring signals of said force measuring sensors 7, 11 and transmits control signals to the adjusting drives (not shown) to swivel the control rollers 5, 9 until the traction strews distribution is equal to a predetermined desired value.

Figure 2:
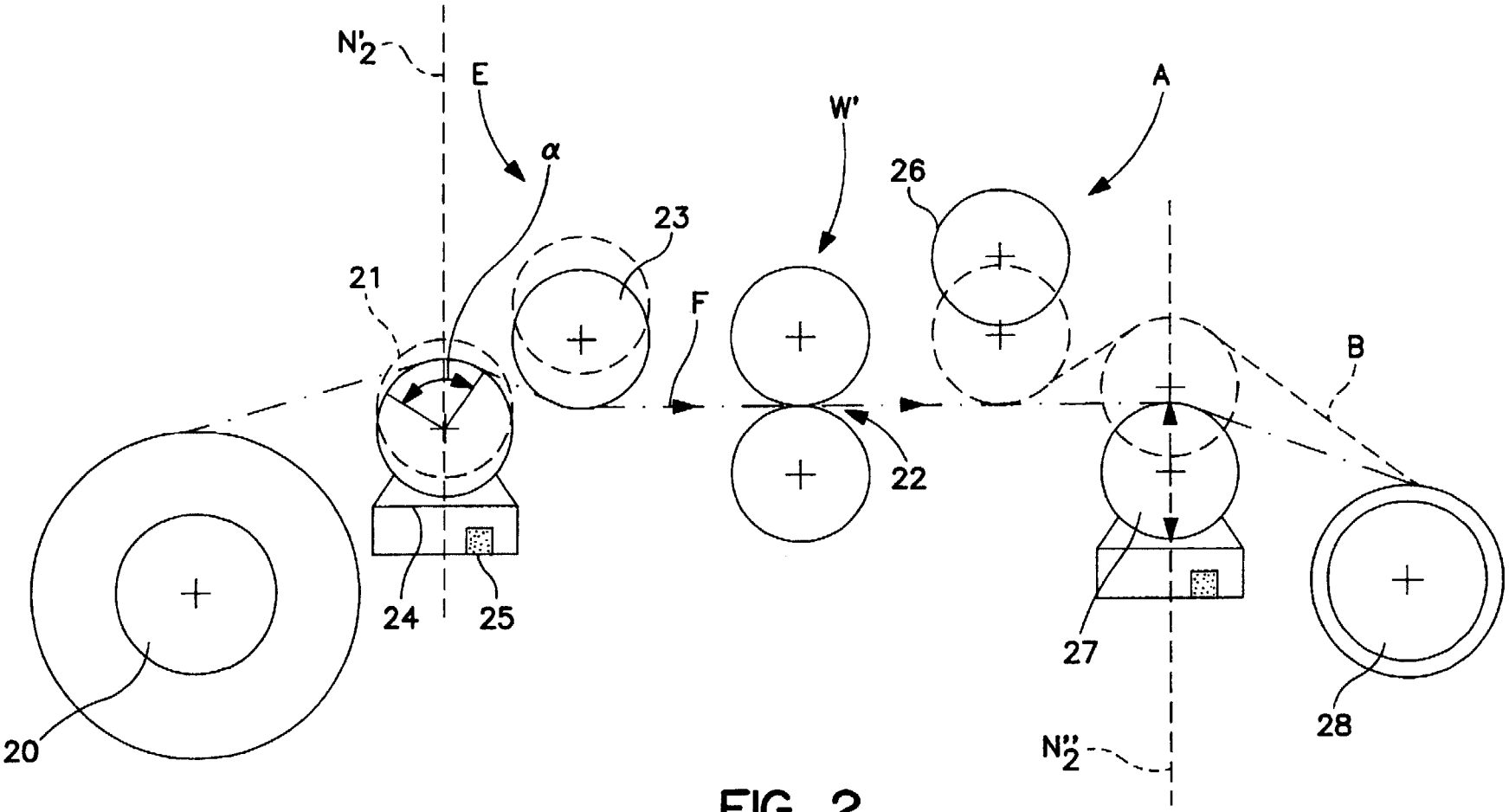
FIG. 2 shows the structure of a second device for the rolling of bands, in a schematic, lateral view

With the device for rolling bands shown in FIG. 2, the band B is conveyed from an uncoiling winch 20 via a first control roller 21 swiveling in in an essentially vertical plane $N_2'$ to the nip 22 of mill W'. Here a deflection roller 23 located above the band B and between the control roller 21 and the mill W acts upon the band B. The deflection roller 23 can be adjusted in height so that the angle α can be changed at which the band B surrounds the control roller 21.

The first control roller 21 is mounted on a bearing block 24 which is designed to determine by means of force measuring sensors 25 the tensile forces acting upon band B on the inlet side E of mill W'. On the outlet side A of the mill W' a second deflection roller 26, adjoining the nip 22, is located. The deflection roller 26 can be adjusted in height and can thus be removed from the band B to such a distance that it is disengaged from the band. Closely adjoining the deflection roller 26 a second control roller 27 is located in the direction of movement F of the band B and can be swiveled via adjusting devices (not shown) in a plane $N_2''$ which is essentially vertical. The band B, after passing the control roller 27, is wound up on a coiling winch 28.

As with the device shown in FIG. 1, the device shown in FIG. 2 also serves to detect the tensile forces acting upon band B on the operating and on the drive side and these are transmitted to a regulating device (not shown). By drive side in this connection, the side of band B is meant which is associated to the side of mill W' equipped with the drives. The operating side is on the other hand the freely accessible other side of the mill W'. The regulating device determines adjusting signals from the detected tensile stress evolution to swivel the control rollers 21, 27 until the detected tensile stress distribution is equal to a desired value.

Figure 3:
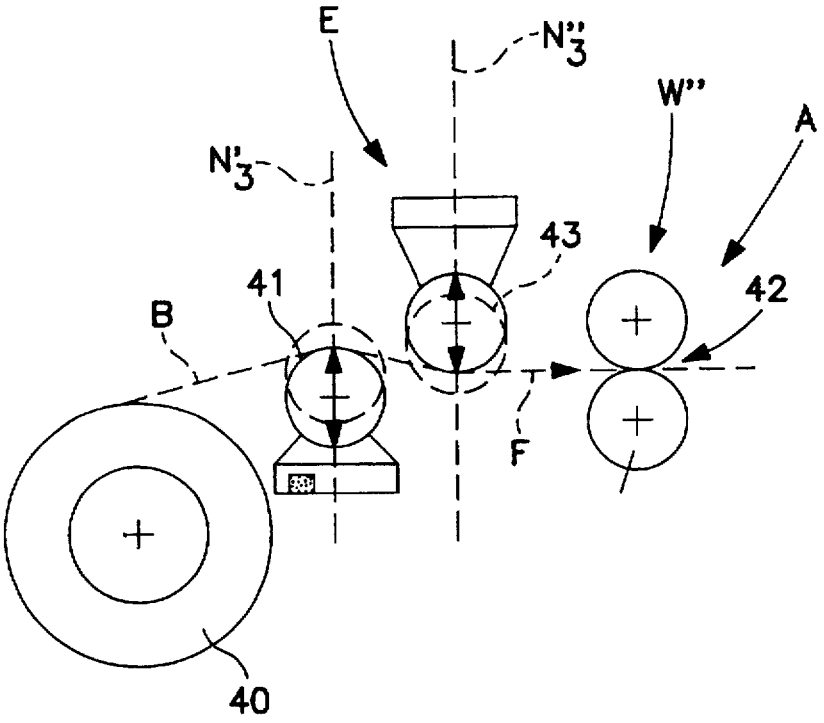
FIG. 3 shows a third device for the rolling of bands in a schematic detailed lateral view.

FIG. 3 shows a detail of a third device for the rolling of bands in which the band B is also conveyed from a coiling winch 40 via a first control roller 21 to the nip 42 of a mill W". By contrast with the device shown in FIG. 2, a second control roller 43 is located between the first control roller 41 and the mill W" to act upon the surface of band B.

The first control roller 41 can be swiveled via an adjusting device (not shown) in a plane $N_3'$ which is essentially vertical. In the same manner the control roller 43 can be swiveled in a plane $N_3''$ which is also vertical.

On the outlet side A the device shown in FIG. 3 has a structure such as the structure on the inlet side E.

As in the devices shown in FIGS. 1 and 2, the distribution of the tensile stresses to which the band B is subjected are also determined by means of appropriate measuring devices in the device according to FIG. 3. The tensile stress distribution is transmitted to a suitable regulating device which transmits adjusting signals to the adjusting drives (not shown) for the swiveling of the control rollers 41, 43 until the distribution of tensile stress is equal to a desired value the control rollers 41, 43 are adjusted here so that they run in opposite directions in order to increase their effect.

The above-mentioned regulations of the tensile stress distribution are merely examples. Depending on the application it may also be useful to regulate only on the inlet or only on the outlet side of the roller frame. In most cases however, regulation will be used only on the inlet side E since flatness regulating systems are often used on the outlet side A of the roller frames W, W', W". When flatness regulation devices are used, the control rollers on the outlet side are set to position "0" in which they exert no influence upon the band. It is however also possible, using the device according to the invention, to act upon the tension distribution in an aimed manner on the outlet side by using the control rollers. In this manner the flatness of the rolled band on the one hand, and the tension distribution at the nip can be adjusted independently from each other.

We claim:

1. A process for compensating for lateral drift occurring on a band via a mill, said band having at least one of an uneven thickness and length distribution over the width of said band, comprising the steps of:

detecting the distribution of tensile stresses over the width of said band via at least one measuring device that is located on at least one of an inlet and outlet side of said mill; and selectively swivelling at least one control roller based on the detected distribution of tensile stresses, said at least one control roller being located on said at least one of said inlet and said outlet side, and each corresponding to a respective one of said at least one measuring device, wherein said at least one control roller is swivelled in at least one of a vertical and horizontal plane relative to said band to selectively compensate said detected distribution of tensile stresses until said stresses substantially equal a predetermined value to compensate for said lateral drift of each said band.

2. The process as in claim 1, characterized in that the tensile stress distribution is calculated from the difference between band traction forces detected on a drive and on an operating side of the mill.

3. A device for compensating for lateral drift occurring on a band via a mill, said band having at least one of an uneven thickness and length distribution over the width of said band, comprising:

at least one measuring device for detecting the distribution of tensile stresses over the width of said band, said at least one measuring device being located on at least one of an inlet and outlet side of said mill; and at least one control roller, each located on said at least one of said inlet and said outlet side and corresponding to a respective one of said at least one measuring device, said at least one control roller being selectively swivelled based on the detected distribution of tensile stresses, wherein said at least one control roller is swivelled in at least one of a vertical and horizontal plane relative to said band to selectively compensate said detected distribution of tensile stresses until said stresses substantially equal a predetermined value to compensate for said lateral drift of each said band.

4. Device as in claim 3, characterized in that at least one control roller is located on the inlet side as well as on the outlet side of the mill.

5. Device as in claim 3, characterized in that the control roller is assigned at least one deflection roller.

6. Device as in claim 3, characterized in that a force measuring sensor is assigned to the bearing block of each control roller.

7. Device as in claim 3, characterized in that at least one of the deflection rollers closest to the respective control roller is assigned a force measuring sensor.

8. Device as in claim 3, characterized in that the distance between the deflection roller and the band can be changed.

9. Device as in claim 3, characterized in that the distance between the control roller and the band can be changed.

10. Device as in claim 3, characterized in that two control rollers offset in the conveying direction of the band are provided on the inlet side and/or on the outlet side of the mill, with one of them acting upon the upper band surface and the other on the lower band surface.

* * * * *